United States Patent [19]

Phillips et al.

[11] Patent Number: 4,982,941

[45] Date of Patent: Jan. 8, 1991

[54] SLOTTED LINK SIDE-TO-SIDE JOGGING APPARATUS

[75] Inventors: Gregory Phillips; Douglas Langton, both of Seattle, Wash.

[73] Assignee: EMF Corporation, Redmond, Wash.

[21] Appl. No.: 420,566

[22] Filed: Oct. 12, 1989

[51] Int. Cl.[5] ..... B65H 29/46

[52] U.S. Cl. ..... 271/84; 271/220

[58] Field of Search ..... 271/267, 84, 207, 220; 414/791.2

[56] References Cited

U.S. PATENT DOCUMENTS 4,091,978 5/1978 Graham ..... 414/791.2 X 4,500,085 2/1985 Rayfield ..... 271/207

*Primary Examiner*—Richard A. Schacher

*Attorney, Agent, or Firm*—Patrick Michael Dwyer; David L. Garrison

[57] ABSTRACT

A jogging apparatus 22 has motor 24 mounted within a support frame 20. Motor 24 has a motor shaft 28 to which is connected hub 30. Projecting outwardly from motor hub 30 along an axis parallel to, but eccentrically offset from, the axis of motor shaft 28 is eccentric pin 34. Slotted link 32 slidably engages slot pins 36 and 38 in transverse slots 42 and 44 respectively of slotted link 32 for transverse movement of slotted link 32. Slotted link 32 also has an orthogonal slot 46 generally perpendicular to transverse slots 42 and 44. Eccentric pin 34 is slidably engaged within orthogonal slot 46 such that as motor shaft 28 is rotated, the rotational motion of shaft 28 is converted into the side-to-side motion of slotted link 32. Eccentric pin 34 projects somewhat beyond the outer surface of slotted link 32 and typically terminates in enlarged head 57. Enlarged head 57, with respect to orthogonal slot 46, describes an up and down movement within slot 46, as motor shaft 28 rotates. To a lower portion of slotted link 32 is attached by pin 58 and bracket 63 a shoe link 56 from which depends a jogging shoe 62. Shoe link 56 has projecting upwardly therefrom, and partly overlapping slot 46, a follower 59. When enlarged head 57 is moving in an upward portion of slot 46, shoe link 56 and shoe 62 are free to hand under the influence of their own weight such that the bottom surface under the influence of their own weight such that the bottom surface of shoe 62 is substantially flat with respect to the sheet of paper 9 being jogged. As enlarged head 57 moves within a lower portion of slot 46 it is engaged by follower 59 to raise shoe link 56 and shoe 62 upwardly and away from sheet 9.

10 Claims, 11 Drawing Sheets

SLOTTED LINK SIDE-TO-SIDE JOGGING APPARATUS

TECHNICAL FIELD

The invention relates to the field of sheet handling devices, particularly paper sheet handlinq devices. More particularly, the invention relates to a sheet jogging apparatus for jogging each of a plurality of individually fed sheets in one of two selectable directions into sheets stacks on trays, bins, or totes.

BACKGROUND OF THE INVENTION

In the paper sheet handling industry many devices are known for jogging individual sheets into stacks of sheets. One such jogging apparatus is disclosed in co-owned and copending U.S. Patent Application Ser. No. 144,539 entitled Paper Sheet Stacking and Jogging Apparatus. In that apparatus, a jogging motor is connected through appropriate gearing to simultaneously impart motion to two orthogonally oriented jogging fingers. These fingers are offset from one another so that a jogging motion is imparted to a sheet against a paper stop in one direction followed immediately by a jogging of the same sheet against an orthogonally oriented paper stop in a second direction by the second finger. In this apparatus, offset job stacks are created by varying the positioning of various sheet stopping surfaces.

Other jogging devices are also known which employ rotating fingers, rotating brushes, vibrating plates, multiple fingered paddle wheels, multiple strips, or belts.

With the exception of the above referenced co-owned apparatus, none of the known jogging devices are particularly effective for use in jogging individual sheets fed from a modern high speed printing or copying device into precisely aligned offset job stacks. Moreover these other jogging devices operate continuously and tend to cause damage to the quality of the printed paper surface and the printing thereon. Finally, these devices tend to be insensitive to the necessity for imparting the jogging motion to the top most recently fed sheet without imparting significant movement forces to sheets next below. Where jogging devices impart movement forces not only to the top most sheet but also to the sheets next below, uneven stacking is the inevitable result.

With respect to the above referenced co-owned invention, which does indeed produce sharply defined offset job stacks from individually fed sheets delivered at high rates of speed, a related orthogonal sheet stop mechanism having movable and repositional first and second sheet stop pairs must be employed to effect the offset stacking. The jogging device above referenced cannot create offset job stacks where there are only stationary sheet stops.

There is therefore a need for a jogging apparatus in the paper sheet handling industry which can jog individual sheets fed from high speed printing or copying devices into precisely defined offset job stacks, and do so without damaging the paper surface or print quality of the sheets. Typically this will require that the jogging mechanism is capable of intermittent, as opposed to continuous, operation. There is also a need for a jogging apparatus which will impart motion of any significant force only to the top most sheet, or the most recently fed sheet, of a job stack. This device should be capable of reversing the direction of its jogging motion to jog sheets selectively against a side sheet stop and backstop, on the one hand, or, alternatively, against a second side stop and the same backstop.

DISCLOSURE OF THE INVENTION

Accordingly it is a general object of the invention to provide a sheet jogging apparatus capable of jogging individually fed sheets of paper, received from a high speed printing or copying device, and deposited within a tray, or tote, assembly, into physically separated, highly defined, multiple job stacks on a large volume, high speed, continuous basis.

It is a further object of the invention to provide an apparatus requiring only one motor to jog sheets selectively into alignment into job stacks on opposite sides of a tote.

It is another object of the invention to provide an apparatus which jogs individually fed sheets selectively in one of two directions orthogonal to the paper path direction.

Another object of the invention is to provide an apparatus which may be adjusted to jog paper sheets of varying weights and frictional characteristics.

It is a still further object of the invention to provide an apparatus which minimizes jamming of sheets during the jogging operation.

It is yet another object of the invention to provide an apparatus wherein the tote assembly is capable of receiving and storing a large quantity of paper sheets separated as desired into one or multiple job stacks or sets.

The invention is an apparatus comprising, in one embodiment, a motor that is mounted within a frame and that has a rotatable motor shaft, a pin eccentrically connected to one end of the shaft, a rear link slidably connected to the frame such that the eccentric pin imparts a transverse movement to this rear link, a front link slidably connected to the rear link such that the eccentric pin imparts to this front link a movement orthogonal to the transverse movement of the rear link, and a jogging shoe connected to the front link.

In another embodiment, the apparatus of the invention comprises a motor that is mounted within a frame and that has a rotatable motor shaft, a pin eccentrically connected to one end of the shaft, a slotted link with at least one transverse slotted opening and one other opening aligned orthogonally to this transverse slotted opening, one or more slot pins mounted on the frame and engaged within the transverse slot or slots such that the slotted link is slidably connected to the frame, and a jogging shoe pivotally connected to the slotted link. In preferred embodiments of this latter embodiment, the eccentric pin will be connected to the motor shaft via a hub. This pin will be mounted in the hub generally parallel to the shaft and will project beyond the outer surface of the slotted link. (The outer surface of the link is the face of the link opposite the motor.) Moreover preferred embodiments of this embodiment will have the jogging shoe pivotally connected to the slotted link by a shoe link, and the shoe link will have a follower projecting upwardly along the outer surface of the slotted link to partially overlap the lower portion of the orthogonally oriented slotted opening in this slotted link. This follower will then follow, or ride, upon the projecting portion of the eccentric pin when the pin is engaged within the lower portion of the orthogonal slot of the slotted link, and thereby cause the jogging shoe and its shoe link to be raised upwardly away from the sheet surface as long as the pin is so engaged in the lower portion of the slot.

Both of these general embodiments of the invention allow for the jogging of large quantities of individually fed and received sheets of paper or other sheet stock from a high volume, high speed source into one or more aligned job stacks.

The apparatus of the invention is preferably employed together with one or more tray or tote assemblies, each of which serves as a depository for the sheets where the sheets may be stacked and jogged into separated, highly defined job sets. The preferred tote assembly supports a large quantity of stacked sheets and is comprised of a floor, a back wall, and at least one side wall. These back and side walls then serve as sheet stops and as alignment means against which the sheets are jogged. The floor serves as the initial receiving surface or platform upon which the first of a series of sheets is stacked, with the upper most of the successively stacked sheets forming the next receiving surface upon which each next successive sheet is stacked. Individual sheets are received from a source, such as a high speed printing or duplicating device, and are tben deposited upon this receiving surface of the tote assembly which is generally located beneath the jogging apparatus of the invention. The jogging apparatus may be used to jog sheets into job stacks either in the direction of the sheet delivery path as the sheets are delivered onto the tote assembly, or preferably in one of two directions transverse to the direction of sheet path delivery.

In preferred embodiments of the invention, a reversible electric motor will be employed and mounted within a frame proximate to the slotted link mechanisms of the invention. Alternatively, however, it is contemplated that other motor means may be employed, and any motor means employed, whether reversible or not, can alternatively be linked to the rotating motor shaft with its hub and eccentric pin by conventional and well known power transmission means, such as but not limited to gearing, motor driven cable, and belts and pulleys.

Also in either of the above two general embodiments, a tote tray system may be employed having either single or multiple tote trays. Where a single tote tray is employed, the tote tray can have an elevating mechanism such as that described in the co-owned and copending application referred to on page 1 of this specification, wherein various sensing means determine the present height of a job stack and the elevating mechanism appropriately lowers the tray floor so that relative height positioning of the receiving surface of the job stack remains approximately the same with respect to the jogging apparatus employed. Such a tray elevating mechanism could be employed with either general embodiment of the present invention.

Where multiple tote tray systems are employed to receive and stack sheets, it is contemplated that it would be advantageous to have the individual tote trays of those tray systems remain relatively vertically stationary during stacking operations. Of course, each tote tray can be slidably mounted within the framework of the overall stacking apparatus so that it can be removed when full. Instead, it is contemplated that a sheet delivery path from the high speed printing or duplicating source terminates in an elevating mechanism within which rides the jogging apparatus of the invention. That is, it is the sheet path end, and the jogging mechanism, which move upwardly with respect to the floor of a tote tray as the job stack or stacks grow higher, and as each tote tray is loaded. This system would have the advantage that, where multiple tote trays are employed, the elevating mechanism of the jogging apparatus can readily be moved upwardly or downwardly to the proper position above the floor of the next available empty tote tray while the one which is full is being removed and off loaded.

In the embodiment employing both a front and rear link, some stopping means is provided to limit the movement of the front link with respect to the rear link so that, as the front link descends with respect to the rear link, it stops at a point of descent and does not continue to follow the motion of the eccentric pin. In this way, although the eccentric pin always describes a circular path, any particular point on the front link would describe only a truncated circular path, or a circular path with a flat spot at the bottom of the circle. The positioning of this stopping means is preferably adjustable to adjust the width of the flat spot on the bottom of the truncated circular path by adjusting how far down the front link can descend with respect to the rear link before it is stopped in its descent. This "flat spot" is the operative jogging path of the jogging shoe, and also the length of jogging movement which the jogging shoe imparts to the paper sheet during each jogging cycle. It will be appreciated that reversing the direction of the motor reverses the direction of this jogging path.

In both general embodiments of the invention the jogging shoe engages the upper surface of a top sheet last deposited within the tray assembly, jogging the sheet into a registered position along the tray back wall and against one of the tray side walls. In both embodiments of the invention, the force of the jogging shoe normal to the top sheet is sufficient to grip and move the top sheet, but not sufficient to be transmitted, to any significant extent, to sheets immediately below. In the front/rear link embodiment, this force is adjusted by means of a variable weight above the jogging shoe. In the single link embodiment, the weight of the jogging shoe and its shoe link are set to optimum values which preferably do not require further adjustment.

The jogging shoe is preferably made of a soft, flexible elastomeric material having a tacky or "sticky" quality toward paper, such that its high frictional characteristics allow the sheets to be engaged by the jogging shoe, with minimal force normal to the sheet, and moved thereby without smearing the surface of the paper or the ink which would otherwise result from shoe slippage on the paper. The jogging shoe is passed in a gently wiping motion across the upper surface of the top sheet of the stack of sheets each time that the shoe passes through the "flat spot" of the jogging cycle, thereby moving the top sheet until the sheet is aligned against the selected aligning sheet stops. The jogging apparatus does not continually rotate, and therefore the jogging shoe makes only a limited number of complete passes each time a sheet is fed onto the stack, and the apparatus then awaits the deposit of the next sheet onto the receiving surface of the stack before bringing the jogging shoe into contact with and jogging the newly deposited sheet. In a preferred embodiment, the jogging shoe makes no more than one pass per sheet.

In preferred embodiments of both of the above described general embodiments, whether single or two link, the jogging shoe is positioned upon a shoe link which in turn is pivotally attached to a lower portion either of the front link, or of the single link, depending on the embodiment under consideration. The shoe link pivots substantially vertically. That is, preferred positionings of the jogging apparatus will align the apparatus so that the transverse slots of the apparatus are substantially horizontal and the other slots in the slotted links of the apparatus are substantially vertical. This is particularly the preferred alignment where tote trays are employed with floors which are substantially horizontal.

However it will be appreciated by those skilled in the art, that other positionings of tote trays, or other receiving trays, may be devised which would benefit from nonstandard positionings of the jogging apparatus. What is needed is that the transverse movement of the jogging shoe at the bottom of its movement path, its "flat spot", which is determined by the axial alignment of the transverse slots in the slotted links, be substantially parallel to the plane of orientation of the receiving surface of the job stack. Thus, tote trays, the floors of which are angled with respect to the horizontal, perhaps to take advantage of gravitational sliding of sheets into side stops or backstops, can be accommodated in the apparatus of the invention by the appropriate positioning of the jogging apparatus so that the transverse slots, and thereby the directions of movement of the jogging shoe are each along a plane which is substantially parallel to the plane of orientation of that tote tray floor. Then the remaining slots of the slotted link, for instance the orthogonal slot of the single slotted link embodiment, are positioned substantially normal to the plane of orientation of the tote tray floor.

An adjustable variable weight may be attached to the shoe link, thereby allowing the frictional forces of the jogging shoe with respect to each deposited sheet, to be adjusted for various paper weights and frictional characteristics, and for various angles of the receiving surface to the horizontal. The combined weight (taken normal to the receiving surface) of the shoe link, jogging shoe, and variable weights, where employed, urges the jogging shoe against the upper surface of the top sheet during the jogging process.

Either general embodiment of the jogging apparatus of the invention will allow a top sheet to be jogged in one of two directions, namely against a first or a second side wall and along a back wall. Where the distance between the respective side walls is greater than the dimension of the paper as measured transverse to the paper path, and if the passing direction of the jogging apparatus is reversed after each jog stack or job set is completed, then the sheets may be jogged into clearly defined and offset uniform job stacks. The apparatus of the invention may be employed with tote trays having side walls with variable positions at different locations on the tray assembly, thereby providing various distances between the first and second side walls, to accommodate offset stacking of differently sized sheets. Sheet delivery sensing means may also be employed with the apparatus of the invention to trigger the operation of the jogging apparatus. Also a sheet delivery sensing means may be provided with a time delay means to allow each incoming sheet to become deposited upon the receiving surface of the tray assembly before the jogging apparatus is activated.

The single slotted link embodiment of the invention represents an improvement over the front and rear link embodiment of the invention. The single slotted link embodiment of the invention has the advantage of further mechanical simplicity and fewer sliding frictional engagements of one part of the linkage with respect to the others, thereby minimizing potential seizure or binding as can occur between front and rear links as dust and impurities and worn surfaces eventually lead to increase in friction between the front and rear links. The slotted link of the single slotted link embodiment resembles the rear link of the other embodiment, and has the same orientation of transverse slots and the same means of slidably engaging slot pins within those transverse slots.

The slotted links of either embodiments serve to isolate from the circular movement of the eccentric pin both a side-to-side component of motion and an up and down component of motion. However, instead of employing a front link to isolate the up and down movement from the eccentric pin, an enlarged head is attached to the end of the eccentric pin, or alternatively the eccentric pin protrudes beyond the outer surface of the link, and, as the enlarged head or pin moves downwardly in the orthogonal slot of the slotted link, engages a follower linkage connected to, and preferably integral to, the shoe linkage which is pivotally mounted on the lower portion of the slotted link. Thus in operation the descending enlarged head moving down the orthogonal slot of the slotted link actuates the follower linkage to raise the shoe link and the shoe from the surface of the paper while the eccentric pin is in its lower semi-circle of movement.

Both before and after the eccentric pin and its enlarged head are low enough in the slot to actuate the follower linkage, the shoe is permitted to rest upon the top sheet of paper solely under the influence of its own weight and that of the pivotally connected shoe linkage, together with any variable weight where employed. The enlarge head and the follower linkage are positioned and dimensioned such as to provide, in the lower semi-circle of the eccentric pin's movement, a raising of the shoe from the paper, but throughout most of the upper semi-circle of the eccentric pin's movement does not actuate the follower linkage and consequently allows the jogging shoe to rest upon the top sheet of paper. Preferably the enlarged head and follower linkage are set so that a follower is engaged by the enlarged head at a point in the eccentric pin's circular movement just ahead of the pin's entry into its lower semi-circle of movement, and so that the enlarged head disengages from the follower link at a point in the eccentric pin's circular movement just after it leaves its lower semi-circle of movement. In this way the jogging shoe of the apparatus is never in contact with the paper while the jogging shoe is changing direction, or about to change direction. This assures a precise and even jogging force for a highly defined job stack.

It should be noted that, due to the difference in slotted link design of the two embodiments here disclosed, the direction of jogging shoe movement with respect to the direction of rotation of the motor shaft also differs. In the front/rear link embodiment the direction of jogging shoe motion is the same as the direction of motor shaft rotation. That is, looking end-on at the jogging apparatus from the outside of the slotted links, a clockwise rotation of the motor shaft will result in a clockwise and leftward jogging movement of the jogging shoe. In the single slotted link embodiment the direction of jogging shoe movement is opposite to the direction of rotation of the motor shaft. That is, with the same orientation as described above, a clockwise rotation of the motor shaft will result in a counterclockwise and rightward movement of the jogging shoe. This difference results from a difference in the portion of the eccentric pins circular movement selected to effect the jogging shoe movement. That is, in the front/rear link embodiment, it is the lower semicircular portion of the eccentric pin's movement which permits the front link to descend to place the jogging shoe into contact with the paper. Consequently, the jogging shoe moves in the expected clockwise direction. However with the single slotted link embodiment, the jogging shoe is normally resting upon the top sheet of paper except when raised by means of the follower linkage. Thus the jogging shoe makes contact with the paper only during a portion of the upper semi-circle of the eccentric pin's movement thereby resulting in a jogging shoe motion which appears to be the opposite of the direction of rotation of the motor shaft.

The dimension of the diameter of the circle of movement for the eccentric pin is largely dictated by the maximum degree of jogging offset which must be produced by the jogging apparatus. For instance, where a ¾ inch jog to either side is desired for offset job stacking, and allowing for a preferred 20% additional margin of overjogging effort to ensure proper and secure alignment of each sheet with its sheet stop, the radius of the circle turned which has just been jogged and to "feather" the shoe for recovery to a start-of-jog position for the next sheet.

It has been found that the orientation of the jogging motor with respect to the direction of the paper feed path has significance. If the jogging apparatus is set up so that the motor shaft, hub, and eccentric pin face the incoming paper so that the swing of the shoe link and shoe as it descends into the jogging position is in the direction opposite to the paper feed path, somewhat uneven stacking results. This is because the jogging shoe in this orientation causes a slight "kick" to the paper just before the jogging motion which tends to jog it away from the back wall paper stop and thus produces a slight but noticeable fuzz to the rear registered surface of the job stack. The jogging apparatus is therefore preferably set up so that the swing of the shoe link and shoe as it descends into the jogging position is in the same direction as the paper feed path for best stacking and jogging results.

In operation of either embodiment, one of the essentials is that in the lower truncated semi-circle of the jogging shoe's movement, the jogging shoe must be raised from its side-to-side motion while it is still moving in the jogging direction. It is preferably not allowed to come to the end of its side jogging travel, that is to the horizontal diametric position of the eccentric pin's movement, much less to pass that position where the direction of jogging shoe travel is actually reversed. Preferably the jogging shoe and its linkage are adjusted so that the jogging shoe is raised at some small increment of arcuate travel of the eccentric pin just prior to reaching the horizontal diametric position. This adjustment position should allow for a range of variation on either side of the selected arcuate offset as a precautionary measure, both for the reasons discussed above, and also to allow for some small variation in job stack height prior to adjustment of the height of the receiving surface by the respective elevating means used.

BEST MODE FOR CARRYING OUT THE INVENTION

Figure 9:
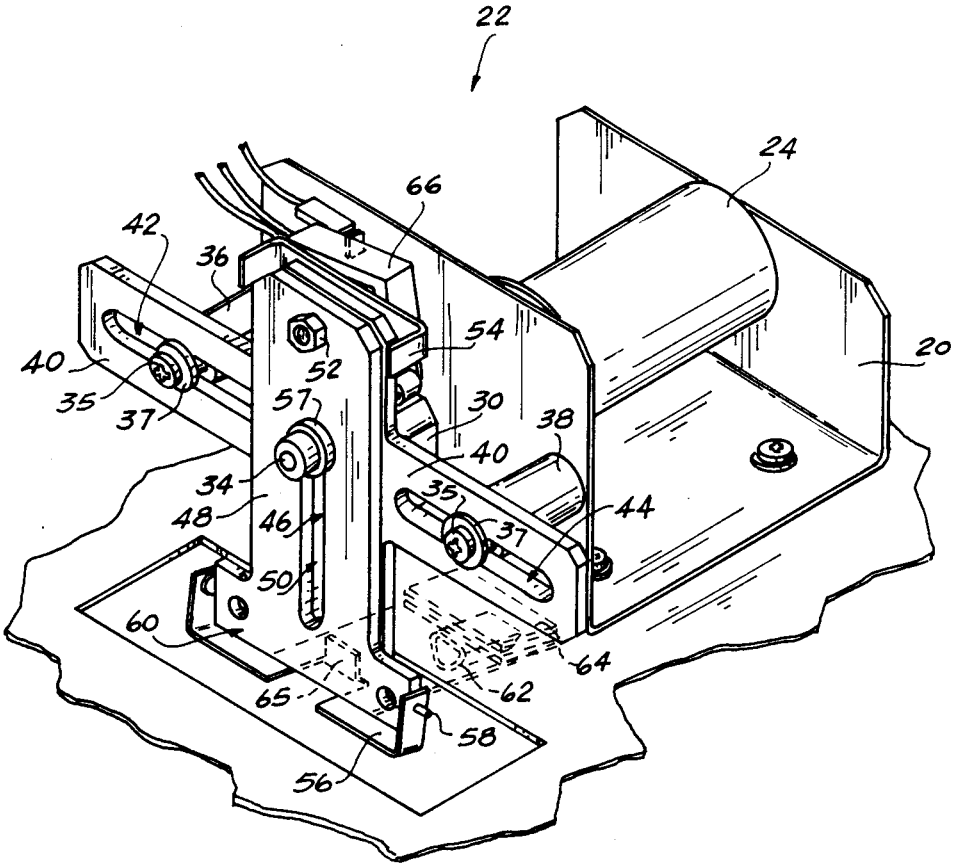
FIG. 9 is a perspective view of a preferred front/rear link embodiment of the invention.
Figure 10:
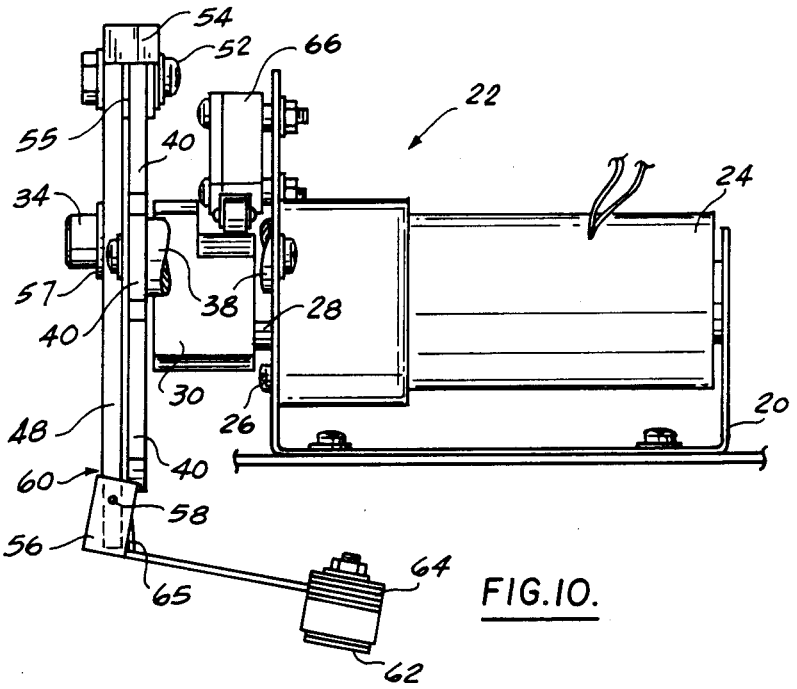
FIG. 10 is a side elevational view of the invention shown in FIG. 9.

Referring now to the drawings wherein like numbers indicate like parts a first embodiment of the apparatus of the invention is illustrated in FIGS. 9–15. In FIGS. 9 and 10 motor 24 is secured to support frame 20 with machine screws 26. Equivalent securing means to machine screws 26 may also be employed such as bolts, welded joints, or the like. Motor 24 has a rotatable shaft 28, the rotation of which may be controlled for both duration and direction of rotation. Hub 30 is attached to shaft 28. Eccentric pin 34 is attached to hub 30 such that the axis of pin 34 is eccentric to but parallel with the axis of shaft 28. Rotation of shaft 28 causes eccentric pin 34 to move in a circular path. Slot pins 36 and 38 are secured to support frame 20. Slot pins 36 and 38 are illustrated in the preferred form as cylindrical but may have any shape whatsoever and be of any dimensions. Larger dimensions are preferred for stability of the apparatus but the dimensions selected should be sufficiently compact so as not to interfere with the motion of hub 30 or jogging shoe 62. Slot pins 36 and 38 should preferably have a wider portion secured to support frame 20 and a narrower portion with a dimension substantially the same as the width of transverse slots 42 and 44, further described below.

A rear link 40 has transverse slots 42 and 44 and an orthogonal slot 46 substantially perpendicular to the axes of slots 42 and 44. The axes of slots 42 and 44 are generally horizontal, particularly wherever the plane of orientation of the associated tote tray floor (not shown) is also horizontal. The axis of slot 46 is then generally vertical so as to be normal to the horizontally oriented tray floor. During operation of jogging apparatus 22 eccentric pin 34 is slidably engaged within slot 46, causing rear link 40 to move horizontally in a direction determined by the axes of slots 42 and 44. This direction is determined due to the fact that slots 42 and 44 are slidably engaged upon slot pins 36 and 38 respectively, and pins 36 and 38 each have portions engaged within slots 42 and 44 respectively which are substantially the same as the width dimension of slots 42 and 44. That is, rear link 40 is free to slide back and forth on slot pin 36 and 38, but is not free to have any other substantial movement in a direction not aligned with the axes of slots 42 and 44. Rear link 40 is connected to stop pins 36 and 38 for sliding movement by screws 35 and washers 37; however other well known means of attaching sliding members together may also be made to serve without departing from the scope of the invention. Slots 42 and 44 are both each of sufficient length to allow unobstructed movement of rear link 40 in the horizontal direction during the movement of eccentric pin 34 in its full circular path.

Eccentric pin 34 is also free to move upwardly and downwardly within slot 46 and slot 46 is therefore of sufficient length to allow unobstructed movement of eccentric pin 34 in the vertical direction during the movement of eccentric pin 34 in its full circular path. Pin 34 preferably has a width, for the portion of pin 34 engaged within slot 46, which is substantially the same as the width of slot 46 for the same reasons as disclosed above for pins 36 and 38 within slots 42 and 44. Rear link 40 therefore serves to isolate a horizontal or side-to-side component of movement out of the circular movement of eccentric pin 34 as a result of the engagement of pin 34 within slot 46, and of the sliding engagement of slots 42 and 44 with pins 36 and 38.

Figure 15:
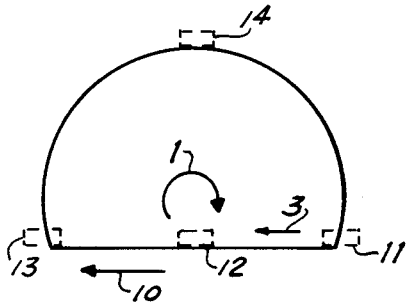
FIG. 15 is a schematic position diagram (from the same perspective as for FIGS. 11–14) illustrating positions of the jogging shoe as it passes through a single jogging cycle.

Front link 48 has a single substantially vertical slot 50. The axis of slot 50 is also parallel to and aligned with the axis of slot 46. Slot 50 is generally shorter in length than slot 46, such that eccentric pin 34, during the upper semi-circle of its movement exerts a lifting force upon front link 48 by coming into contact with the upper end of slot 50. Front link 48 therefore rises and falls during the upper semi-circular portion of eccentric pin 34's motion according to whether eccentric pin 34 is rising or falling in that semi-circular portion of motion. An auxiliary pin 52 connected to front link 48 and slidably engaged within slot 46 prevents front link 48 from pivoting about eccentric pin 34 and maintains thereby the substantially vertical orientation of front link 48. Other means such as side rails or grooves may be substituted for pin 52 without departing from the scope of the invention. Thus during operation of jogging apparatus 22, eccentric pin 34 slides within slots 46 and 50 causing front link 48 to move along a generally truncated circular path. That is, any particular point on front link 48 will describe a circular path with a "flat spot" at the bottom of the circle, the length of which flat spot is determined as further described below and is schematically illustrated in FIG. 15.

During the lower semi-circular portion of the motion of eccentric pin 34 in a jogging cycle, front link 48 assumes its lowest vertical position short of the bottom of the circular movement of pin 34, and any particular point on front link 48 then moves horizontally, parallel to the axes of slots 42 and 44. This is because the naturally occurring downward motion of front link 48 as it attempts to follow the downward motion of eccentric pin 34 is arrested by a front link stopping means. In a preferred embodiment, this stopping means is an angular stop 54 which is preferably secured to pin 52. Angular stop 54 is positioned to rest upon rear link 40 at some point in the downward travel of front link 48, thereby vertically supporting front link 48 while eccentric pin 34 continues its rotation through its lower semi-circle of motion. Having an angular stop 54 to arrest the downward motion of front link 48 allows jogging shoe 62 to describe the above mentioned truncated circular path with a "flat spot." Thus jogging shoe 62 in preferred embodiments presses down upon the top sheet of paper only with its own weight and not also with the weight of all or a portion of front link 48.

An alternative stopping means is achieved by placing a washer 55 between rear link 40 and front link 48 such that pin 52 passes through washer 55. Eccentric pin 34 is then provided with an enlarged head 57 having a diameter which is larger than the width of slot 50. As eccentric pin 34 passes through its lower semi-circle of motion, front link 48 descends under its own weight and becomes frictionally bound between a lower end of rear link 40, the enlarged head 57, and washer 55. (See FIG. 10). This binding effect restricts front link 48 from further vertical movement much below the point at which the binding occurs, allowing front link 48 thereafter to follow a horizontal path until eccentric pin 34 again exerts a lifting force upon the upper end of slot 50.

Shoe link 56 is pivotally connected by pin 58 to a lower end 60 of front link 48. Shoe link 56 supports a jogging shoe 62 and an adjustable variable weight 64. Shoe link 56 is designed and positioned to cause jogging shoe 62 to be approximately centered over a deposited sheet of paper. Such centering may be achieved by properly attaching jogging apparatus 22 to support frame 20. When front link 48 assumes its lowest position, jogging shoe 62 rests upon the upper surface of sheet 9. Jogging shoe 62 is urged against the sheet by weight 64. Weight 64 is adjustable to enable the downward gravitational forces exerted on jogging shoe 62 to be adjusted. Jogging shoe 62 is preferably made of a material which has a high coefficient to friction. For example, jogging shoe 62 may be made of a very flexible material which has a tacky or "sticky" quality toward paper. Jogging shoe 62 may be constructed of an elastomer, such as polyurethane, having a durometer hardness of about 60 (sixty). Other suitable material for gently moving the top sheet of a stack of sheets which will occur to those skilled in the art may also be used.

Tab stop 65 is provided to restrict the downward pivotal movement of shoe link 56. In this way, tab stop 65 prevents jogging shoe 62 from contacting the upper surface of sheet 9 when eccentric pin 34 is traveling through the upper semi-circle of its motion. That is, when jogging shoe 62 is lifted upwardly away from the sheet as eccentric pin 34 moves into its upper semicircle of motion and begins to raise front link 48 thereby, tab stop 65 prevents shoe support 56 from pivoting downward beyond a predetermined position. In a preferred embodiment, tab stop 65 comes into contact with the inner surface of the lower end 60 of front link 48 when front link 48 is lifted by pin 34.

Switch 66 is secured to support frame 20 to register each revolution or rotation of hub 30 and to forward such information to a central computer or processor (not shown) which controls the power to motor 24 and thereby, the rotation of shaft 28. In this manner, shaft 28 may be controlled to rotate hub 30 and eccentric pin 34 a predetermined number of revolutions, thereby causing jogging shoe 62 to move the sheet a predetermined distance to be aligned against the sheet stops (not shown) of the tote tray assembly (not shown). In a preferred embodiment, hub 30 is designed to serve as a cam to displace a switch arm of switch 66. Other apparatus and methods of registering the rotation of hub 30 may also be used to serve the same function without departing from the scope of the invention, such as well known light path optical sensing devices.

The rotational direction of shaft 28 may be reversed after each job stack or job set has been deposited, jogged and aligned. This enables jogging apparatus 22 to align deposited sheets against different sets of sheet stops or alignment means, such as alternate side walls of the tray assembly, thereby providing easily identified job separation.

In FIGS. 11–14 the apparatus is viewed facing the front/rear links of the apparatus. FIGS. 11–14 illustrate the movement of portions of the apparatus of the invention with respect to each other as eccentric pin 34 moves about its circular path. Each of FIGS. 11–14 are spaced approximately 90 degrees apart in that circular movement and have been selected as typical of the positions which the respective parts of the apparatus will assume as the apparatus operates.

Figure 11:
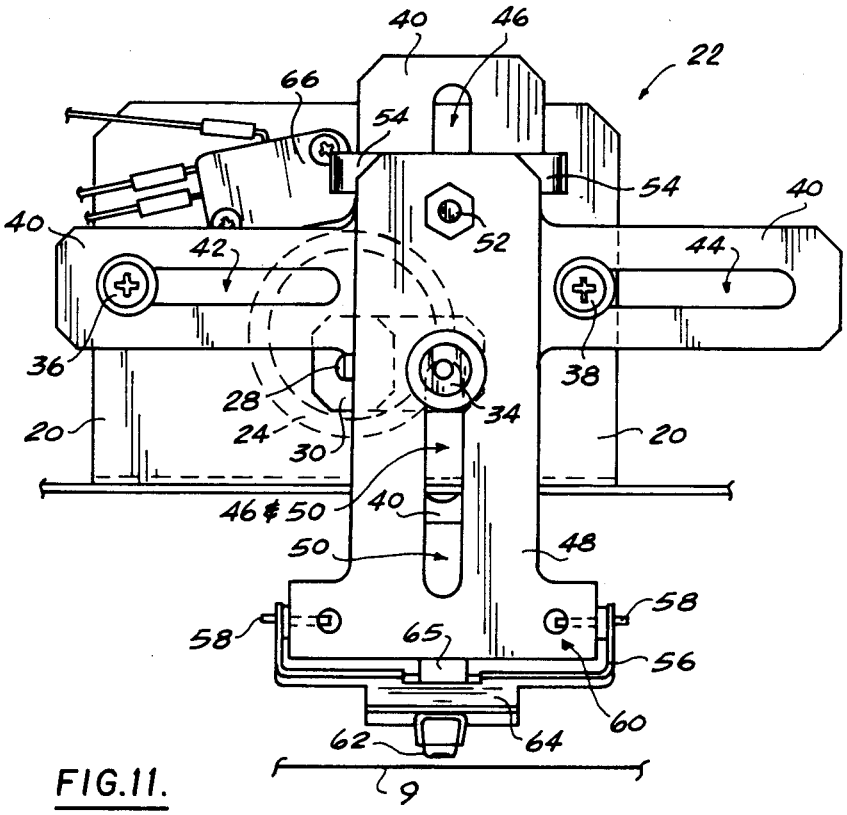
Figure 12:
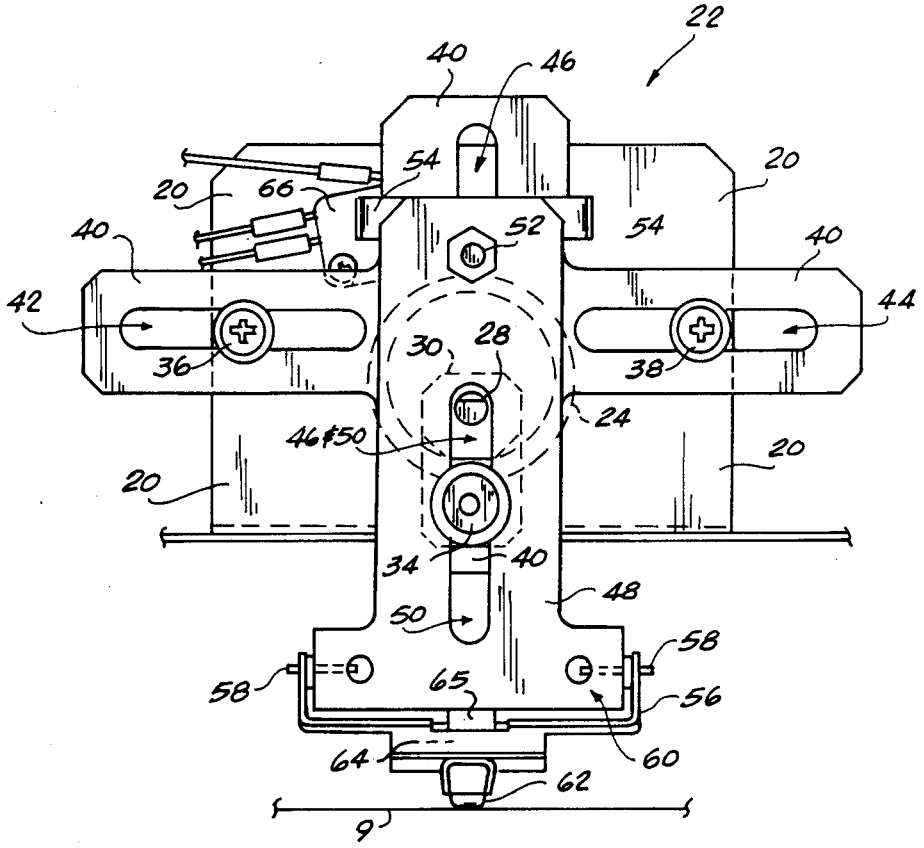
Figure 13:
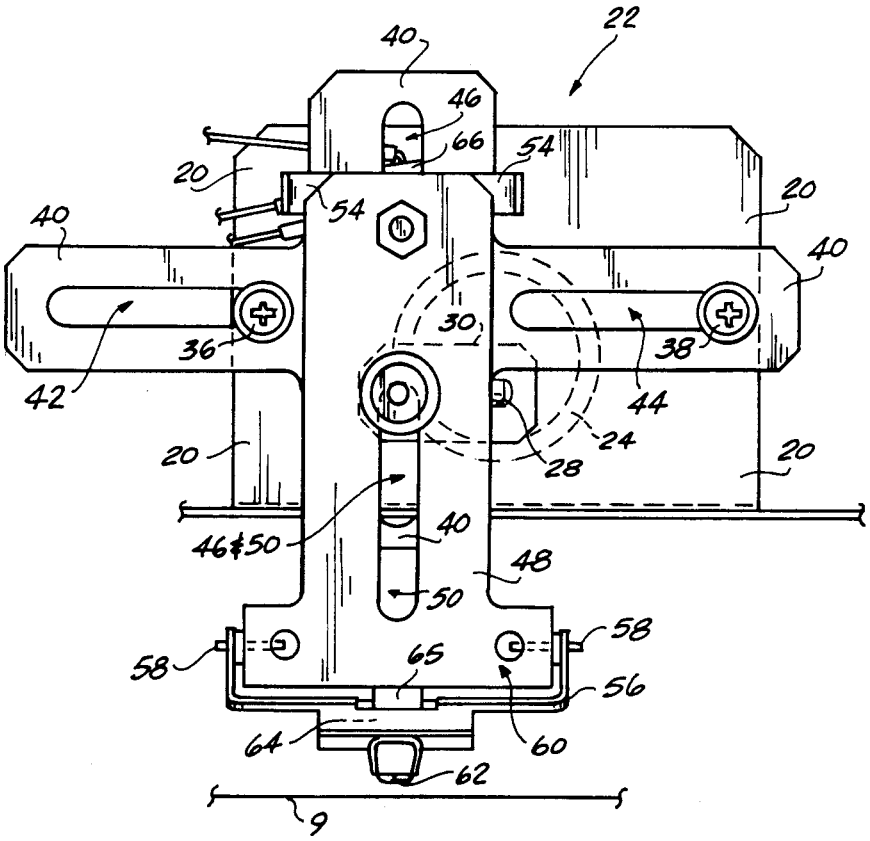

In FIG. 11, eccentric pin has moved through its circular arc to its far right-most position. This description will assume that the eccentric pin is traveling in a clockwise circular path; however, with an appropriate mirror reversal of terminology and positions, this description will also apply to counterclockwise rotation of the eccentric pin about its circular path. The position of eccentric pin 34 in FIG. 11 is the position occupied by pin 34 at the start of what has been termed elsewhere in this specification as the lower semi-circular portion of its movement. FIGS. 12 and 13 illustrate two other positions along this same lower semi-circular portion of movement. When eccentric pin 34 is in the position illustrated in FIG. 11, rear link 40, because of its interengagement with eccentric pin 34, has been moved to its far right-most position and jogging shoe 62 is also in its far right-most position. Front link 48 has already begun its decent from its upper-most position (illustrated in FIG. 14) and is near, but not at, the point at which angular stop 54 will arrest its downward movement because of the interference of angular stop 54 with a portion of rear link 40, so that front link 48 descends no further beyond that point of pin 34's movement. When the apparatus is properly adjusted, jogging shoe 62 will be in contact with sheet 9 only after the downward motion of front link 48 is arrested. As discussed further above this contact ideally begins with eccentric pin 34 having progressed some degree beyond its horizontal diametric position, or its far right-most position as described above (illustrated in FIG. 11), in order to ensure that jogging shoe 62 is not going to reverse its direction, or be in the midst of a reversal of direction, as it makes contact with the sheet of paper. Again, as discussed above, this degree of offset from the horizontal diametric position can range from no offset at all to a considerable offset (where the desired jogging distance is very small), but preferably ranges from a small fraction of a degree beyond the horizontal diametric position to 5 degrees beyond. The range is set primarily to allow for changes in the height of sheet 9 with respect to the jogging apparatus as the job stack grows in height.

In FIG. 12 eccentric pin 34 has rotated to its bottom most position without any further substantial downward movement of front link 48, but with rear link 40, and consequently front link 48, having been moved to the left approximately half of their travel, with the result that jogging shoe 62 has also been moved to the left by half of its jogging distance. In FIG. 13 eccentric pin 34 has completed its lower portion of semi-circular movement and is in its left most diametrical position In this position rear link 40 has been pushed as far leftwards as it will go in the cycle and jogging shoe 62 has completed its jogging distance. Eccentric pin 34 has already made contact with the upper end of slot 50 to exert an upward lifting influence on front link 48. The same considerations for the adjustment of the apparatus with respect to contact of the jogging shoe with sheet 9 apply to this position as were applied to the position illustrated in FIG. 11. That is, eccentric pin 34 must begin to lift front link 48, and consequently jogging shoe 62, from the sheet of paper before eccentric pin 34 completes its lower portion of semi-circular movement lest jogging shoe 62 be lifted from the paper while it is in the midst of, or just beginning, a reversal of its direction.

FIGS. 13 and 11 also illustrate, as suggested above, the starting and ending points respectively of a jogging cycle when the direction of rotation of shaft 28, and eccentric pin 34, is counterclockwise.

Figure 14:
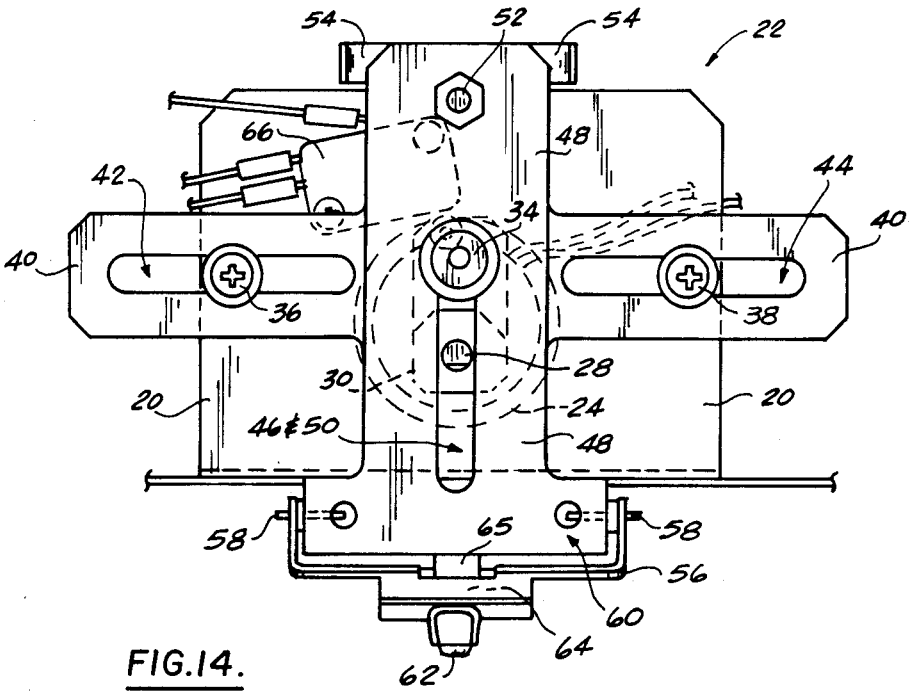
FIGS. 11–14 are end elevational views (from the same perspective as for FIGS. 4–7) illustrating four dispositions of the apparatus during a single jogging cycle.

In FIG. 14 eccentric pin 34 is in its top most position and has completed approximately half of its upper semi-circular portion of movement. Front link 48 has been raised to its top most position by eccentric pin 34 pushing upwardly against the end of slot 50 in front link 48. Jogging shoe 62 is at the top of its truncated circular movement. This is a position typical of the recovery stage of the jogging shoe's motion as schematically illustrated in FIG. 15. Rear link 40 has progressed approximately half of its rightward travel and is progressing to the point illustrated in FIG. 11 where front link 40 will have completed its rightward travel and jogging shoe 62 will be ready to complete its next jogging movement.

FIG. 15 is a schematic illustration of the path taken by an arbitrarily and imaginarily selected point on the bottom center of jogging shoe 62 as jogging shoe 62 goes through its truncated circular path For illustration purposes it is assumed that shaft 28 and eccentric pin 34 are turning in a clockwise direction of rotation 1. As discussed above in the description of FIGS. 11–14 this results in a direction of jogging shoe movement 3 which in turn results in a direction of sheet movement 10. Illustrative positions of shoe 62 in FIG. 15 are shown in broken lines as 11, 12, 13, and 14, corresponding to the positions occupied by jogging shoe 62 in FIGS. 11–14, respectively.

Figure 1:
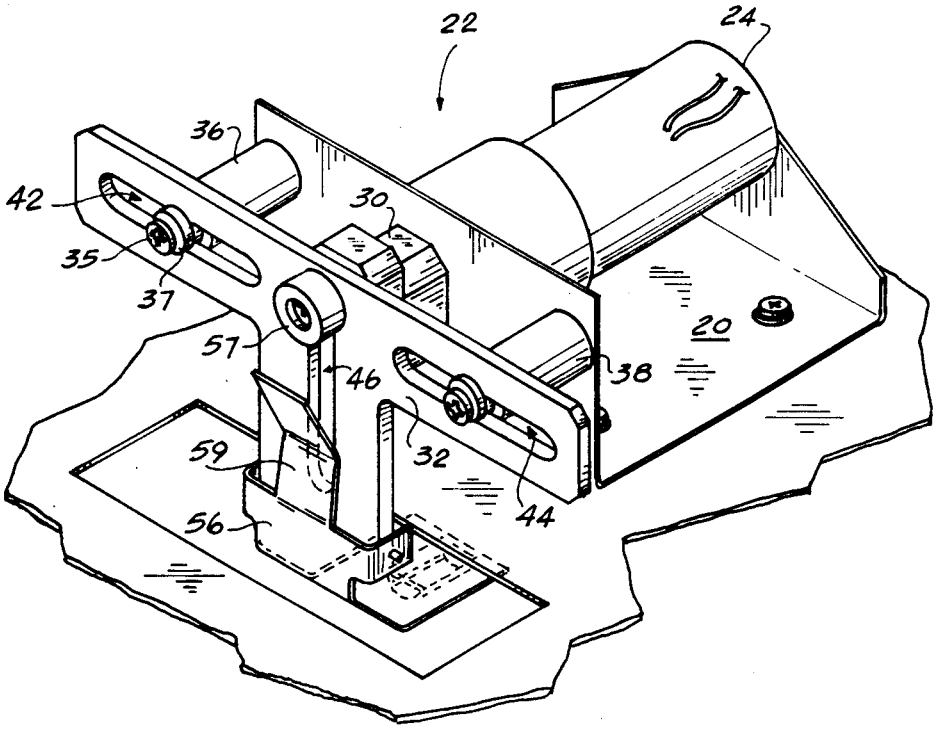
FIG. 1 is a perspective view of the preferred single slotted link embodiment of the apparatus of the invention.
Figure 2:
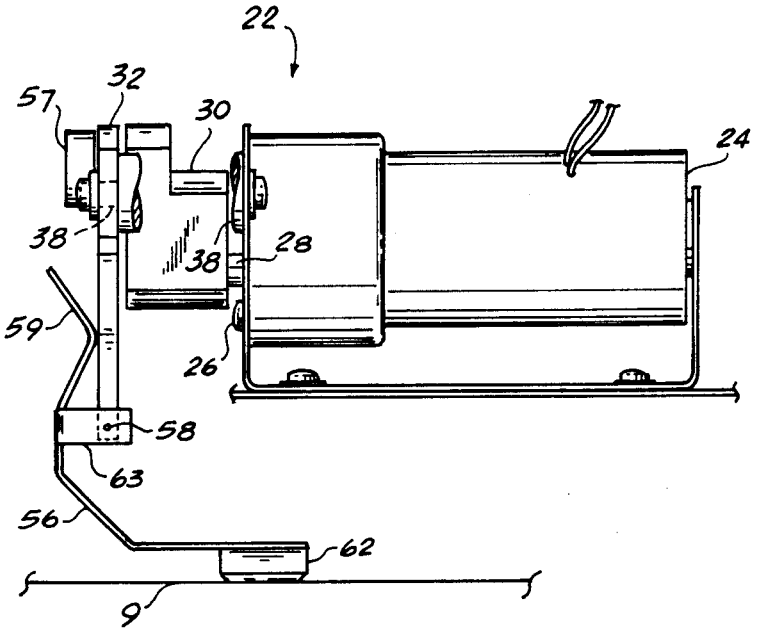
FIGS. 2 and 3 are side elevational views of the invention shown in FIG. 1 showing shoe 62 respectively engaged and disengaged from paper sheet 9.
Figure 3:
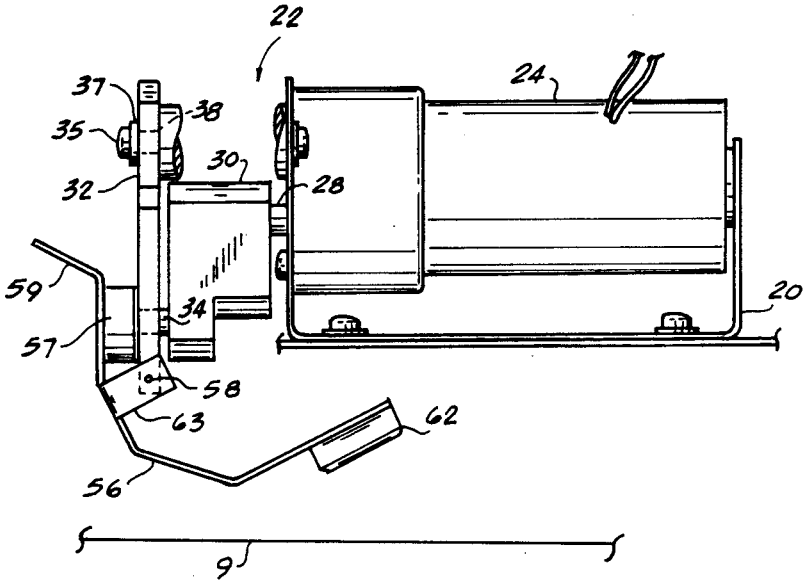

FIGS. 1–8 illustrate an alternative embodiment of the jogging apparatus 22 of the invention. In FIGS. 1–3 the apparatus of the invention is shown in perspective and side elevational views respectively. Motor 24 is attached to support frame 20 with machine screws 26. Motor 24 has motor shaft 28 to which is connected hub 30. Eccentric pin 34 is mounted in hub 30 in such a way that as motor shaft 28 rotates eccentric pin is moved through a circular path. Eccentric pin terminates at its end opposite hub 30 in an enlarged head 57. Enlarged head 57 may be integral to pin 34 or may be attached with some suitable fastening means, such as for instance, a screw.

Also connected to support frame 20 are slot pins 36 and 38. The considerations for dimensioning and positioning of slot pins 36 and 38 for this alternative embodiment are substantially the same as for slot pins 36 and 38 discussed above with respect to FIGS. 9 and 10. A slotted link 32 having transverse slots 42 and 44 and a slot 46 orthogonal to the axis of slots 42 and 44 slidably engages slot pins 36 and 38 in the same manner as rear link 40, described with respect to FIGS. 9 and 10, engages slot pins 36 and 38 in those figures. Slotted link 32 is free to move from side-to-side in transverse directions as eccentric pin 34 rotates through its circular movement, eccentric pin 34 being slidably engaged in slot 46.

Figure 8:
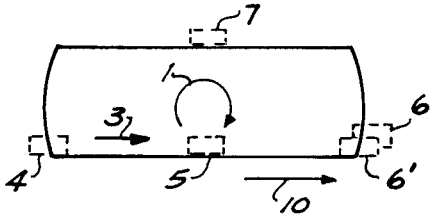
FIG. 8 is a schematic position diagram from the same end elevational orientation as in FIGS. 4–7 illustrating the jogging cycle of the invention.

As eccentric pin 34, with its enlarged head 57, moves through its lower semi-circular portion of its circular movement, it is partly or completely in engagement with follower 59 (See FIG. 3), such that shoe link 56, with which follower 59 is integral in preferred embodiments, is raised pivotally upwardly by shoe link 56's pivotal connection with a lower portion of slotted link 32 via pin 58 and bracket 63. Follower 59 may also be conventionally attached to shoe link 56, as opposed to being integral to it, as will be appreciated by those skilled in the art. Jogging shoe 62, being connected to shoe link 56, is also raised upwardly during this portion of the circular movement of pin 34. Thus jogging shoe 62 is not in contact with sheet 9 during this phase of movement. This phase of the jogging cycle of the jogging apparatus 22 is schematically illustrated in FIG. 8 as the lower line of the two parallel lines in FIG. 8.

As eccentric pin 34 leaves its lower semi-circular portion of movement, enlarged head 57 disengages from follower 59 which allows shoe link 56 and jogging shoe 62, under the influence of the weight of shoe 62, link 56, and follower 59, pivoting about pin 58, to descend into contact with sheet 9 (See FIG. 2).

FIGS. 4–7 and FIG. 8 illustrate for this apparatus typical positions spaced approximately 90 degrees apart with respect to the movement of eccentric pin 34 through its circular path, presenting the same kinds of positions and distinctions and movements of the parts of the apparatus with respect to each other as were illustrated in FIGS. 11–14 and 15. There exists a principle distinction however. As discussed above, given a common direction of rotation 1 of motor shaft 28 for each general embodiment (FIGS. 9–14 and FIGS. 1–7) a direction of movement of jogging shoe 62 will be opposite in one embodiment as compared to the other. In the first above described embodiment of the apparatus (FIGS. 9–15) a clockwise direction of rotation 1 resulted in a generally clockwise direction of motion 3 of jogging shoe 62, and a concomitant leftward direction of motion 10 of sheet 9. For this presently discussed embodiment (FIGS. 1–8) of the invention a clockwise direction of rotation 1 of motor shaft 28 results in a generally counterclockwise direction of motion 3 of jogging shoe 62 and concomitant rightward direction of motion 10 of sheet 9.

Figure 7:
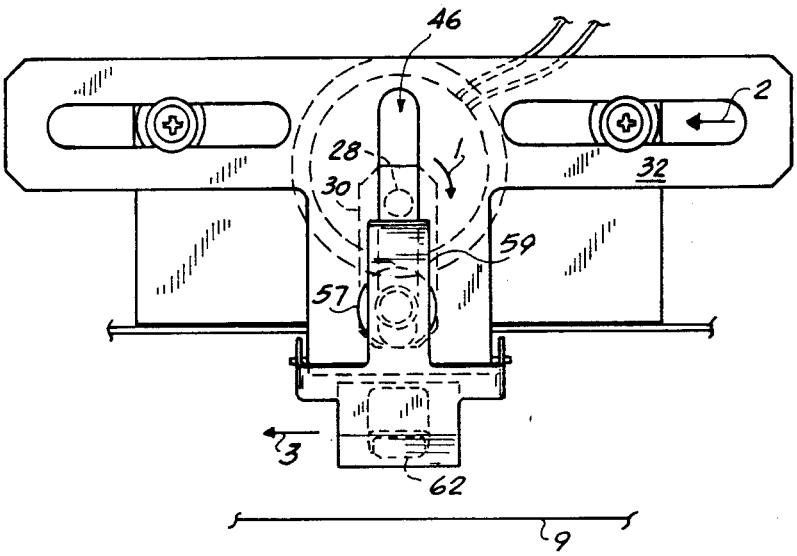
FIGS. 4–7 are end elevational views of the invention shown in FIGS. 1–3 from the outer side of the slotted link respectively illustrating four positions in the jogging cycle of the invention.
Figure 4:
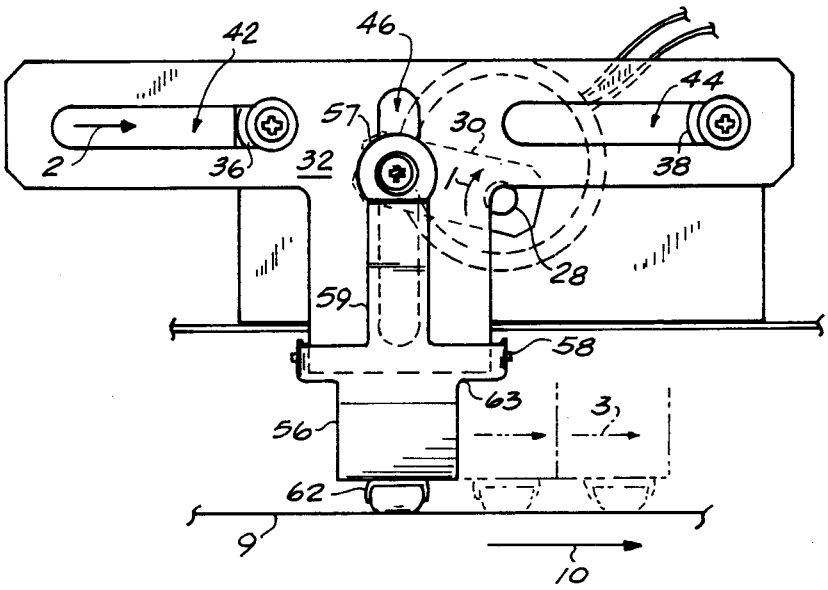
Figure 6:
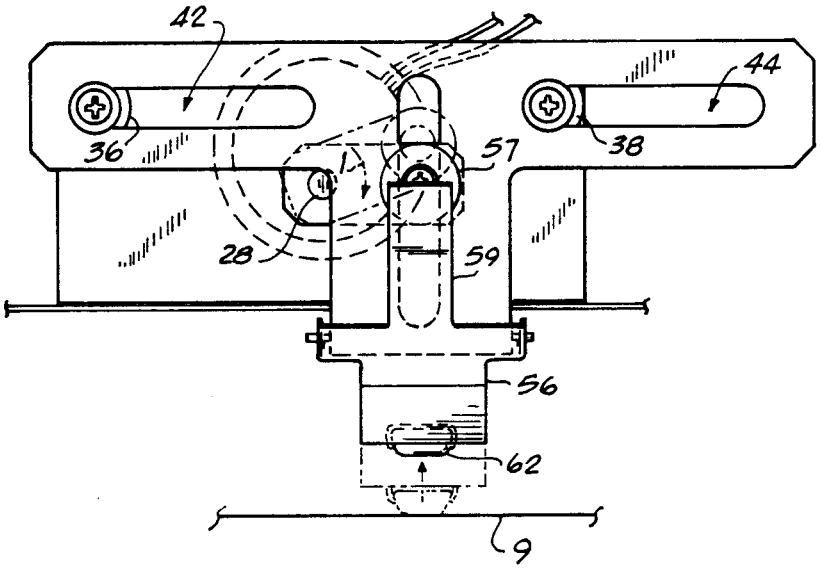

In FIGS. 6 and 7, jogging shoe 62 is raised above sheet 9 because of the interaction of enlarged head 57 with follower 59 causing shoe link 56 to uplift shoe 62 from sheet 9. However in the position illustrated by FIG. 4, enlarged head 57 has just left its engagement with follower 59, so that jogging shoe 62 is free to descend to sheet 9 and begin the jogging stroke. As motor shaft 28 turns in direction of rotation 1 eccentric pin 34 and enlarged head 57 break off their engagement with follower 59 causing jogging shoe 62 to descend and make contact with sheet 9. Slotted link 32 which is in its left most position as a result of the motion of eccentric pin 34 within slot 46, now begins its rightward travel resulting in a rightward traveling of jogging shoe 62 as illustrated in FIG. 4 by successive positionings of jogging shoe 62 in broken line in the direction of jogging shoe motion 3. This results in a movement of sheet 9 in the direction of sheet movement 10.

Figure 5:
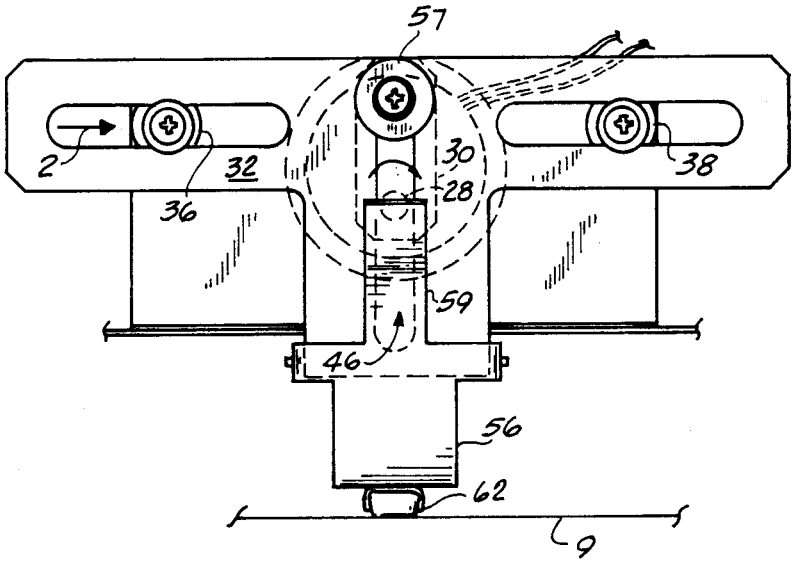

FIG. 5 is illustrative of positions of the apparatus halfway through the jogging stroke. Slotted link 32 moving in the direction of slotted link movement 2, has moved rightwardly half of its travel, with the result that jogging shoe 62 has also moved halfway through its jogging stroke. Since eccentric pin 34 and enlarged head 57 are not in contact with follower 59, jogging shoe 62 has maintained its contact with sheet 9. In FIG. 6, the apparatus has come to the end of its jogging stroke (shown by positionings in broken line), and then enlarged head moves into engagement with follower 59 to raise jogging shoe 62 to its upward position (shown in unbroken line). This is the beginning of the recovery phase of the jogging shoe motion schematically illustrated in FIG. 8. Slotted link 32 is now at its right most positioning and as motor shaft 28 rotates in direction of rotation 1 into the position illustrated in FIG. 7, slotted link 32 will begin to move to the left in direction of slotted link movement 2 illustrated in FIG. 7. FIG. 7 shows eccentric pin 34 and enlarged head at the bottom of the semi-circular portion of its movement with jogging shoe 62 fully retracted and raised and halfway through its recovery motion with jogging shoe 62 fully "feathered". The cycle is completed as eccentric pin 34 and enlarged head 57 come to the position again illustrated in FIG. 4 to begin the jogging stroke by lowering jogging shoe 62 to contact with sheet 9.

The schematic illustration depicted in FIG. 8 further highlights the differences in motions between the two above described embodiments of the invention. Whereas the first above described embodiment (FIGS. 9–14) moves as illustrated in FIG. 15 with a truncated circular motion of jogging shoe 62, the embodiment of the invention described just above (FIGS. 1–7) moves as illustrated in FIG. 8 with a circular motion which is truncated both above and below. As motor shaft 28 turns in the direction of rotation 1 eccentric pin 34 and enlarged head 57 move out of engagement with follower 59 so that jogging shoe 62 is placed in position 4 in FIG. 8 corresponding to the position of jogging shoe 62 in FIG. 4. Because the eccentric pin 34 is moving through the upper portion of its semi-circular motion, assuming for discussion a clockwise direction of rotation, slotted link 32 is moved to the right with a result that jogging shoe 62 also moves to the right in direction of jogging shoe motion 3 resulting in the jogging of sheet 9 to the right in direction of sheet jogging 10. Schematic positioning 5 corresponds with the position of jogging shoe 62 in FIG. 5 halfway through the jogging stroke. Schematic positionings 6, and 6 correspond respectively to the positioning of jogging shoe 62' and 62 illustrated by broken and solid lines respectively in FIG. 6. Position 7 in FIG. 8 corresponds to the position of jogging shoe 62 in FIG. 7, after enlarged head 57 has moved into engagement with follower 59 at position 6, resulting in the raising of jogging shoe 62 and the reversal of direction of movement of the jogging shoe as eccentric pin 34 moves through its lower semicircular portion of its movement.

In preferred embodiments of the apparatus of the invention slotted link 32, rear link 40 and front link 48 are made of an acetal copolymer such as CELCON®. Slot pins 36 and 38, and eccentric pin 34, are made of stainless steel. In preferred embodiments, the material selected for use in jogging shoe 62 is a silicon rubber with a durometer hardness of 25, available from Molded Chemical Products, Kirkland, Washington. In a preferred embodiment, the weight of the combined shoe/shoe link combination is 0.5 ounces, and the center of mass of shoe 62 is positioned approximately 0.16 inches inside the inner surface of slotted link 32 and beneath motor 24.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, approximately interpreted in accordance with the doctrine of equivalents.

INDUSTRIAL APPLICABILITY

The invention will find use in the paper sheet handling industry, particularly where the jogging of high speed, individually fed sheets into offset job stacks is desireable, or required. The invention makes use of a mechanically simple slotted link design to change the rotary movement of a motor shaft into a transverse movement of a jogging shoe. The transverse motion of this jogging shoe is imparted to each successively fed sheet on the particular job stack, in the offset direction in which the job stack is being formed. The mechanical linkage of the invention prevents the jogging shoe from dragging on or touching the individual sheet except when the jogging shoe is traveling in the proper transverse direction for the proper jogging motion.

The invention may be employed in many different conventional and high speed stacking apparati and may be employed with a number of different sheet delivery and tote stacking systems. The action of the jogging shoe is precise and imparts little if any momentum to sheets immediately below the sheet to be jogged. It is anticipated that savings in manufacturing costs and in sheet handling costs can be realized from the invention, while at the time same time achieving more precisely defined offset job stacks.

We claim:

1. A jogging apparatus for imparting a jogging motion to each of a plurality of individually fed sheets, said apparatus comprising:

(a) a motor mounted within a frame and having a rotatable motor shaft;

(b) a pin eccentrically connected to one end of said shaft;

(c) a rear link slidably connected to said frame, said eccentric pin imparting a transverse movement to said rear link;

(d) a front link slidably connected to said rear link, said eccentric pin imparting to said front link a movement orthogonal to said transverse movement; and (e) a jogging shoe connected to said front link.

2. The apparatus of claim 1 wherein the rotation of said eccentric pin in a circular path about the axis of said shaft causes said jogging shoe to move along a generally truncated circular path, said jogging shoe making contact with each of said sheets as it passes through the lower truncated portion of said truncated circular path.

3. A jogging apparatus for imparting a jogging motion to each of a plurality of individually fed sheets, said apparatus comprising:

(a) a motor mounted within a frame and having a rotatable motor shaft;

(b) a hub connected to said shaft;

(c) a slotted link having at least one transverse slot therein and an orthogonal slot therein generally perpendicular to said transverse opening;

(d) a plurality of slot pins mounted upon said frame and engaged within said transverse slot, whereby said link is slidably connected to said frame;

(e) an eccentric pin mounted in said hub for movement in a circular path, the axis of said pin generally parallel to but offset from the axis of said shaft, said pin slidably engaged within said orthogonal slot and projecting beyond said outer surface of said slotted link; and (f) a jogging shoe pivotally connected to said slotted link by a shoe link, said shoe link having a follower projecting therefrom, said follower disposed for engagement with said eccentric pin during a portion of said pin's circular movement.

4. The apparatus of claim 3 wherein said follower is disposed along an outer surface of said slotted link to overlap a lower portion of said orthogonal slot.

5. The apparatus of claim 3 wherein said motor is of the reversible type.

6. The apparatus of claim 5 wherein said motor is of a type which may be controlled for intermittent rotation.

7. The apparatus of claim 4 wherein said eccentric pin terminates at the end of said eccentric pin which projects beyond the outer surface of said slotted link in an enlarged head.

8. The apparatus of claim 3 in which said transverse slots are substantially horizontal and said orthogonal slot is substantially vertical.

9. The apparatus of claim 8 wherein the axes of said transverse slots lie generally parallel to the direction of said jogging motion.

10. The apparatus of claim 3 wherein said slot pins are mounted upon said frame generally perpendicular to said frame.

* * * * *